US005662513A

United States Patent [19]

Cuhel

[11] Patent Number: 5,662,513

[45] Date of Patent: Sep. 2, 1997

[54] BRASSIERE STRAP FASTENER AND METHOD USING SAME

[75] Inventor: Rostislav Cuhel, Jamestown, N.Y.

[73] Assignee: Koh-I-Noor, Prague, Czech Rep.

[21] Appl. No.: 600,463

[22] Filed: Feb. 13, 1996

[51] Int. Cl.[6] ..... A41F 15/02; A41F 9/00

[52] U.S. Cl. ..... 450/28; 24/316; 24/326; 224/194; 224/264; 2/1; 2/312; 2/268

[58] Field of Search ..... 24/523, 510, 505, 24/707.7, 709.2, 316, 326, 482, 338; 2/1, 312, 318, 319, 323, 324, 327, 330, 333, 334, 338, 339, 268; 450/14, 26, 28, 86; 224/182, 194, 264, 269, 665, 666, 667, 668, 669

[56] References Cited

U.S. PATENT DOCUMENTS

| | | | |
|---|---|---|---|
| 380,125 | 3/1888 | Lewis | 24/510 X |
| 1,559,587 | 11/1925 | Pilcher et al. | 24/482 |
| 2,210,275 | 8/1940 | Bertling | 2/324 X |
| 2,654,132 | 10/1953 | Norcross | 2/323 X |
| 2,719,303 | 10/1955 | Lodenius | 2/323 X |
| 2,898,598 | 8/1959 | Morris et al. | 24/510 X |
| 4,040,147 | 8/1977 | King | 224/264 X |
| 4,062,065 | 12/1977 | Gardner | 224/264 X |
| 4,175,306 | 11/1979 | Bigelow et al. | 24/510 X |
| 4,260,089 | 4/1981 | Daleo | 224/264 X |
| 4,881,672 | 11/1989 | Gustafson | 224/264 |
| 4,953,233 | 9/1990 | Moshier | 2/268 |
| 5,036,552 | 8/1991 | Deakyne . | |
| 5,117,538 | 6/1992 | Henry | 224/264 X |
| 5,353,479 | 10/1994 | Lucier | 24/326 |
| 5,441,188 | 8/1995 | Rosenstein | 224/264 |

*Primary Examiner*—C. D. Crowder
*Assistant Examiner*—Shirra L. Jenkins
*Attorney, Agent, or Firm*—McAulay Fisher Nissen Goldberg & Kiel, LLP

[57] ABSTRACT

A clothing accessory device comprises a body part, a first fastener on the body part for coupling the body part to a strap of a brassiere, and a second fastener on the body part for coupling the body part to an article of clothing overlying the brassiere during use thereof. The second fastener includes a spring loaded mechanism or component for engaging and fixing the article of clothing relative to the body of the clothing accessory device. The spring loaded mechanism generally includes a pair of opposed jaws biased towards one another by a spring. The jaws may be slidably or translatably coupled and biased towards one another by a compression spring. One of the jaws is fixed to the body part of the clothing accessory device and the other jaw is provided on an ancillary member slidably coupled to the body part, the compression spring being disposed between the ancillary member and the body part.

17 Claims, 6 Drawing Sheets

BRASSIERE STRAP FASTENER AND METHOD USING SAME

BACKGROUND OF THE INVENTION

This invention relates to a brassiere strap fastener. This invention also relates to a method for using the fastener.

It is well known that brassiere straps and overlying garments such as blouses frequently shift to one side or another relative to one another during normal use, thus revealing one or both brassiere straps. A shifting of the overlying article of clothing is especially pronounced when the garment has a wide or plunging neckline and is made of a low-friction material such as silk. A brassiere strap can also fall down along the upper arm or towards the neck, depending on motions and postures of the wearer. In any event, the wearer is frequently required to reorient the garment or to shift the brassiere strap laterally back under the garment. This can be inconvenient, or even embarrassing, particularly when the wearer is involved in conversation with one or more acquaintances.

OBJECTS OF THE INVENTION

An object of the present invention is to provide a device for maintaining brassiere straps hidden beneath overlying garments.

A related object of the present invention is to provide a device for maintaining brassiere straps in place on the user's shoulders.

Another object of the present invention is to provide such a device which is removable and thus utilizable with different brassieres and different blouses, shirts or dresses.

A related object of the present invention is to provide such a device which is convenient and easy to use.

Yet another object of the present invention is to provide such a device which is inexpensive.

A further object of the present invention is to provide a method for preventing brassiere straps and an overlying garment from slipping relative to one another, thereby maintaining the brassiere straps hidden from view.

SUMMARY

A clothing accessory device comprises, in accordance with the present invention, a body part, a first fastener on the body part for coupling the body part to a strap of a brassiere, and a second fastener on the body part for coupling the body part to an article of clothing overlying the brassiere during use thereof.

Preferably, the second fastener includes a spring loaded mechanism or component for engaging and fixing the article of clothing relative to the body of the clothing accessory device. This spring loaded mechanism generally includes a pair of opposed jaws biased towards one another by a spring. In a specific embodiment of the invention, the jaws are slidably or translatably coupled and biased towards one another by a compression spring. One of the jaws is fixed to the body part of the clothing accessory device and the other jaw is provided on an ancillary member slidably coupled to the body part, the compression spring being disposed between the ancillary member and the body part.

In another specific embodiment of the invention, the jaws are pivotably attached to the body part, and the spring is a torsion spring.

Whether the jaws pivot or translate relative to the body part, it is advantageous if the jaws engage one another in a plane oriented substantially perpendicularly to the brassiere strap when the brassiere Strap is coupled to the body part via the first fastener. This enables the jaws to grasp an inwardly extending fabric edge along a shoulder seam of the garment.

In another embodiment of the present invention, the spring loaded mechanism is a fork with resilient prongs. The fork is pivotably attached to the body part to enable alternate locking and release of the fork to the body part. In an unlocked or released configuration, the fork is used to pierce the fabric of the overlying article of clothing. The fork, and more specifically the tips of the prongs thereof, is then locked to the body part to substantially fix the clothing accessory device to the article of clothing.

In accordance with another feature of the present invention, the first fastener, for attaching the brassiere strap to the accessory device, includes a slot provided on the body part. Alternatively, the first fastener includes a band having at least one end removably attached to the body part.

A clothing method comprises, in accordance with the present invention, providing a brassiere, a woman's garment, and a coupling device; attaching the coupling device to a strap of the brassiere; securing the coupling device to the garment along an inner side thereof; and applying the brassiere and the garment to a person, the coupling device connecting the brassiere strap to the garment so that the brassiere strap remains hidden under the garment at all times.

Where the coupling device includes a spring loaded component, the securing of the coupling device to the garment includes operating the spring loaded component to releasably catch the garment.

Where the spring loaded component includes a pair of opposed jaws biased towards one another by a spring, the operating of the spring loaded component including exerting a force against a bias of the spring to separate the jaws from one another. In that case, the securing of the coupling device to the garment further includes inserting a part of the garment between the open jaws and closing the jaws on the inserted garment part.

In accordance with another feature of the present invention, during use of the coupling device, the jaws engage the garment in a plane oriented substantially perpendicularly to the brassiere strap. This is particularly useful where the garment part is an inwardly extending edge section of the garment fabric disposed along a shoulder seam of the garment.

In the case that the jaws are located on parts of the coupling device which are slidably or translatably connected to one another, the operating of the spring loaded component includes linearly shifting the jaws relative to one another in opposition to a spring force.

Where the spring loaded component includes a fork with resilient prongs, the securing of the coupling device to the garment includes a step of piercing the garment with the prongs. More specifically, where the fork is pivotably attached to the body part, the securing of the coupling device to the garment includes pivoting the fork from a latched position to an opened or released position. Then the garment is pierced with the prongs, and subsequently the fork is pivoted back from the opened position to the latched position.

In accordance with one feature of the present invention, the attaching of the coupling device to the brassiere strap includes inserting the brassiere strap into a slot on the coupling device. In accordance with an alternative feature of the invention, the attaching of the coupling device to the brassiere strap includes passing a band about the brassiere strap and fastening the band to the coupling device.

A device in accordance with the present invention serves to maintain brassiere straps hidden beneath overlying garments. A woman using the device need no longer worry about whether her brassiere straps are showing. There is no longer any need to continually readjust the relative location of a brassiere strap and an overlying garment.

A device in accordance with the instant invention is removable and thus utilizable with different brassieres and different blouses, shins or dresses. The device is inexpensive, convenient and easy to use.

DESCRIPTION OF THE PREFERRED EMBODIMENTS

Figure 2:
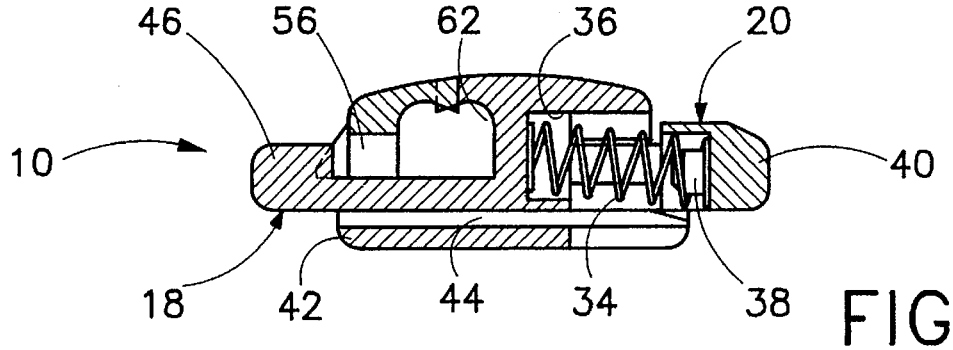
FIG. 2 is a cross-sectional view taken along line II—II in FIG. 1.
Figure 1:
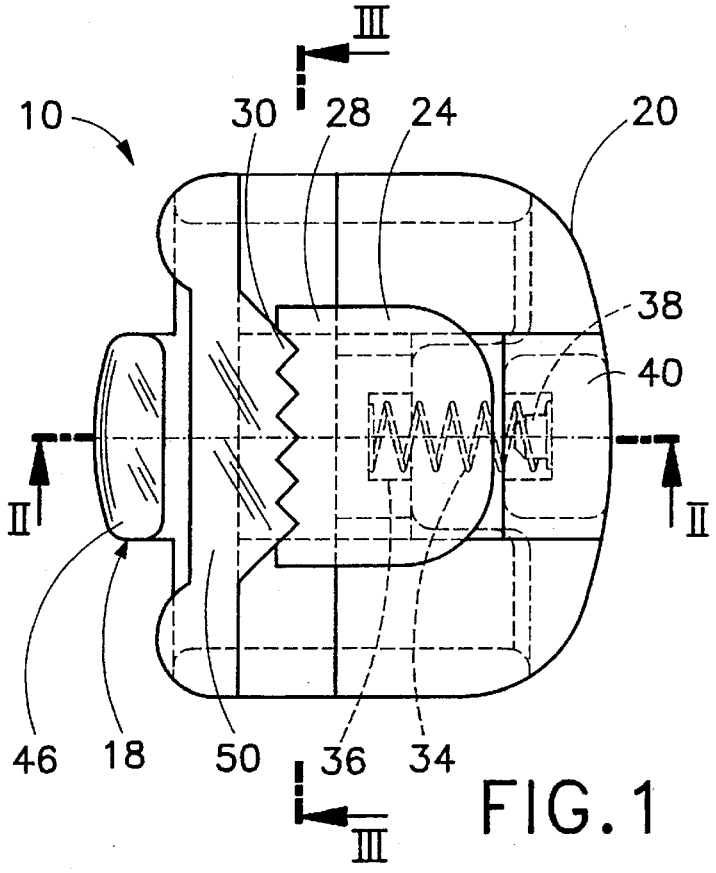
FIG. 1 is a top plan view of a brassiere clip or strap fastener in accordance with the present invention.
Figure 7:
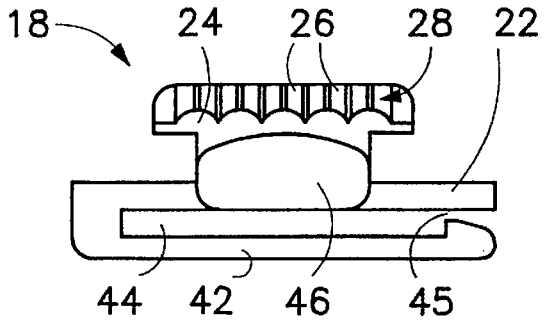
FIG. 7 is a front elevational view of the body part of FIG. 4, viewed from the left in FIG. 4.
Figure 8:
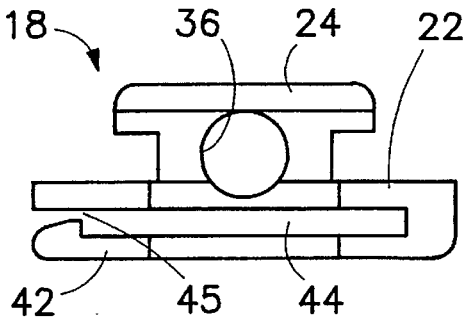
FIG. 8 is a rear elevational view of the body part of FIG. 4, viewed from the right in FIG. 4.
Figure 6:
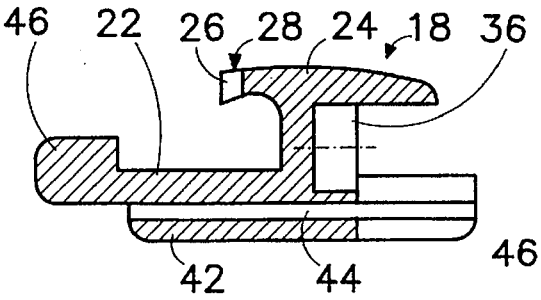
FIG. 6 is a cross-sectional view taken along line VI—VI in FIG. 4.
Figure 4:
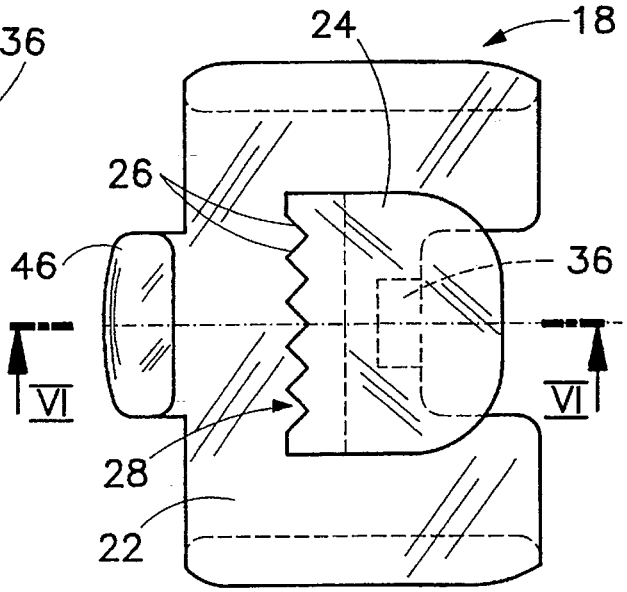
FIG. 4 is a top plan view of a first body part of the brassiere clip or strap fastener of FIGS. 1–3.
Figure 5:
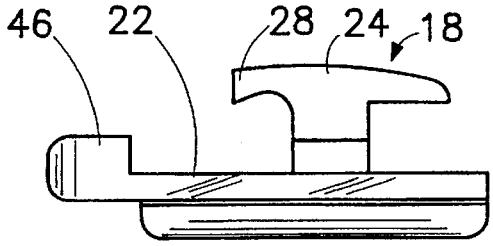
FIG. 5 is a side elevational view of the body part of FIG. 4, viewed from the bottom in FIG. 4.
Figure 25:
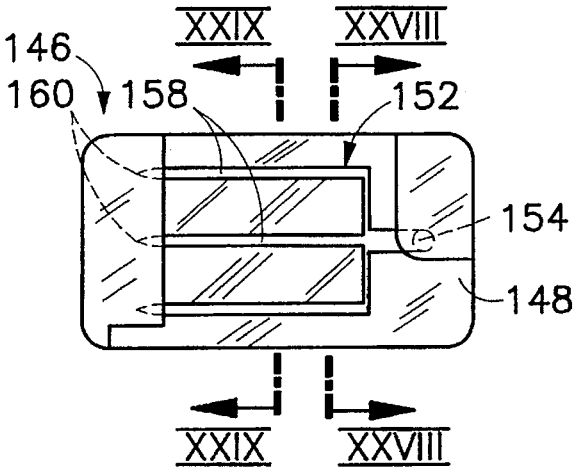
FIG. 25 is a top plan view of a yet another brassiere clip or strap fastener in accordance with the present invention.
Figure 26:
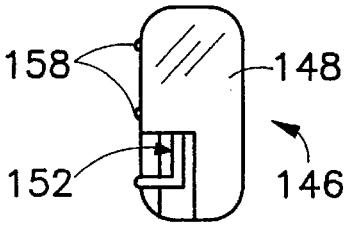
FIG. 26 is a side elevational view of the brassiere clip or strap fastener of FIG. 25, taken from the right side in FIG. 25.
Figure 28:
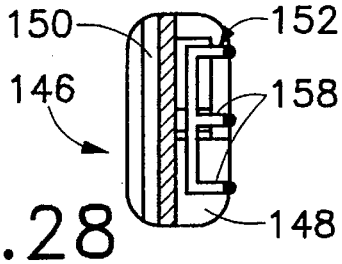
FIG. 28 is a cross-sectional view taken along line XXVIII—XXVIII in FIG. 25.
Figure 27:
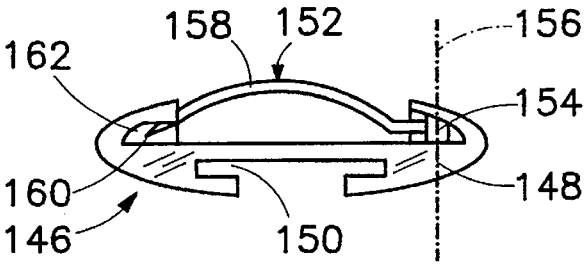
FIG. 27 is a front elevational view of the brassiere clip or strap fastener of FIG. 25, taken from the bottom in FIG. 25.
Figure 29:
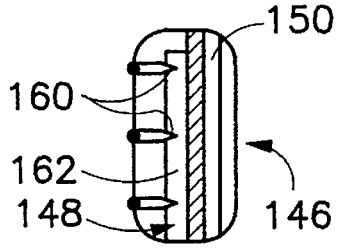
FIG. 29 is a cross-sectional view taken along line XXIX—XXIX in FIG. 25.
Figure 10:
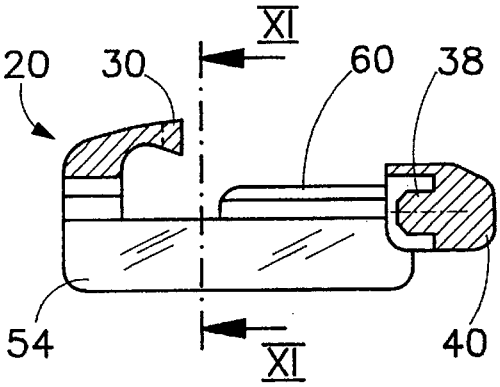
FIG. 10 is a cross-sectional view taken along line X—X in FIG. 9.
Figure 30:
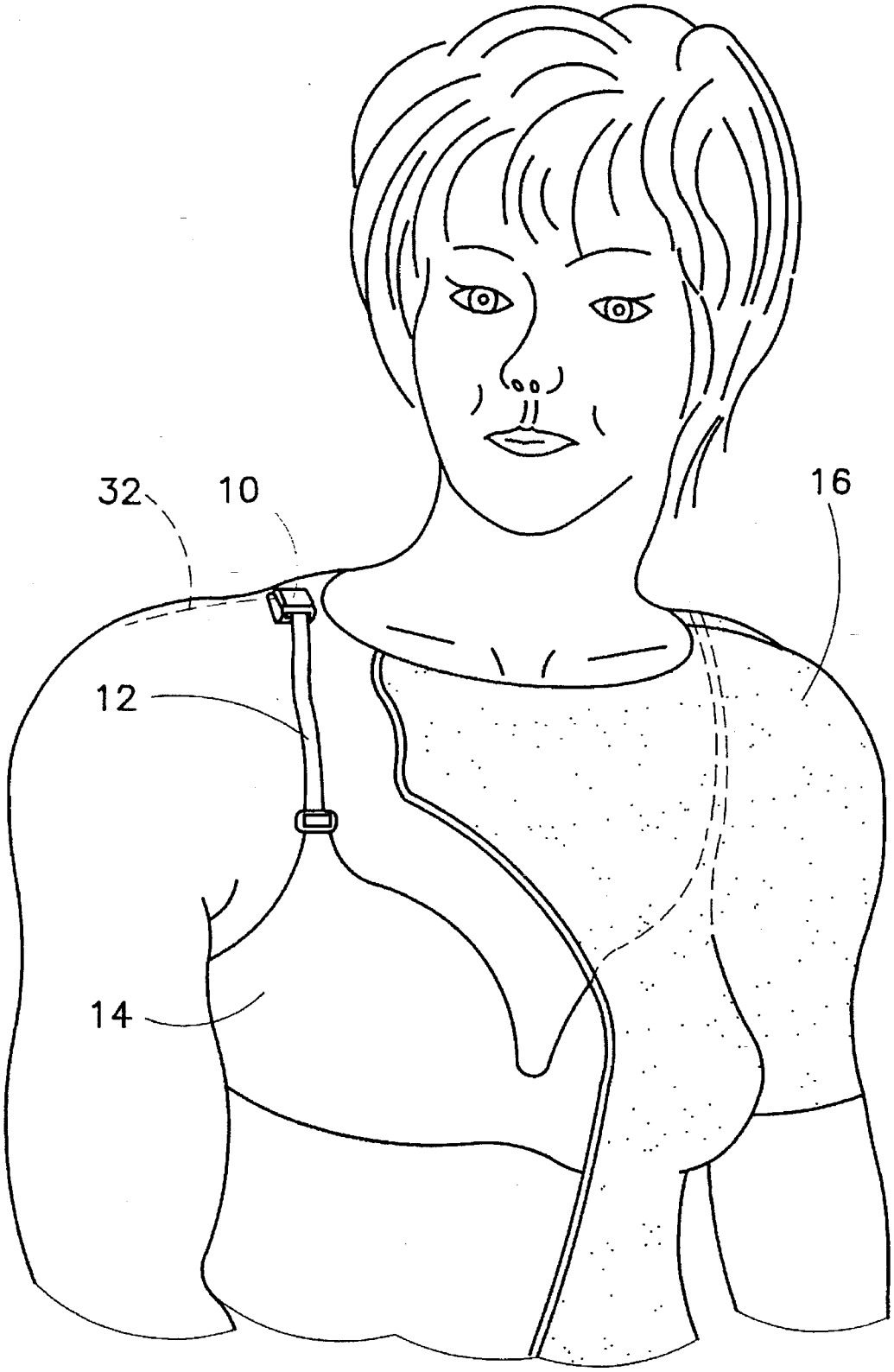
FIG. 30 is a schematic perspective view, partially broken away, of a person with clothing utilizing a brassiere clip or strap fastener in accordance with the present invention.

As illustrated in FIGS. 1–13, a brassiere fastener or coupling device 10 for securing a strap 12 (FIG. 30) of a brassiere 14 to an overlying garment such as a blouse 16 (FIG. 30) comprises a first body part 18 (FIGS. 1–8) and a second body part 20 (FIGS. 1–3 and 9–13) slidably coupled to one another. As best seen in FIGS. 4–8, first body part 18 includes a plate 22 with an integral head 24 provided with a row of serrations or teeth 26 collectively defining a jaw 28. Jaw 28 cooperates with another jaw 30 provided on body part 20 (see FIGS. 9–11) to catch or rasp an inwardly projecting fabric edge along a shoulder seam 32 (FIG. 30). Pans 18 and 20 of brassiere fastener or coupling device 10 are biased towards one another by a helical compression spring 34 (FIGS. 1 and 2). At one end, spring 34 is seated in a recess 36 formed in body part 18. At an opposite end, spring 34 is press fitted about a lug or peg 38 provided on a push block 40 at one end of body part 20. Spring serves in part to hold body parts 18 and 20 to one another.

As shown in FIGS. 2, 3, 7 and 8, body part 18 is provided along a lower face with a base plate 42 which defines a slot 44 for receiving brassiere strap 12. Generally, strap 12 is inserted into slot 44 sideways through an elongate mouth 45 (FIGS. 3, 7, 8) thereof. To have device 10 grasp seam 32 of blouse 16, a user generally holds the brassiere accessory device between a thumb and a forefinger (not shown) with one digit resting against push block 40 of body part 20 and the other digit effectively engaging a push block 46 provided on the other body part 18. Pressing push blocks 40 and 46 towards one another compresses spring 34 and separates jaws 28 and 30 from one another. The inwardly extending material along shoulder seam 32 is then inserted between the separated jaws 28 and 30, whereupon the compressive pressure exerted on spring 34 via push blocks 40 and 46 is released and the jaws are closed.

Figure 11:
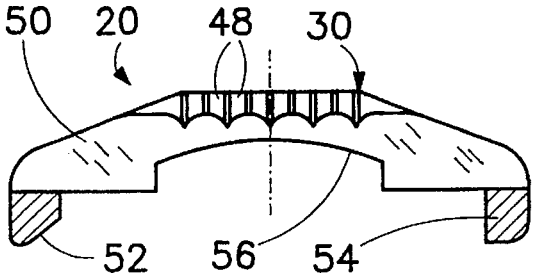
FIG. 11 is a cross-sectional view taken along line XI—XI in FIGS. 9 and 10.
Figure 13:
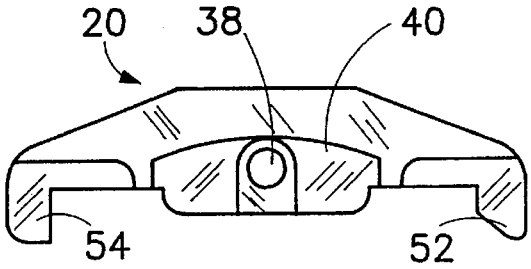
FIG. 13 is a from elevational view of the body part of FIG. 9, taken from the left in that figure.
Figure 12:
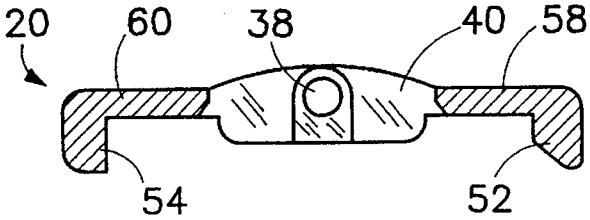
FIG. 12 is a cross-section view taken along line XII—XII in FIG. 9.
Figure 9:
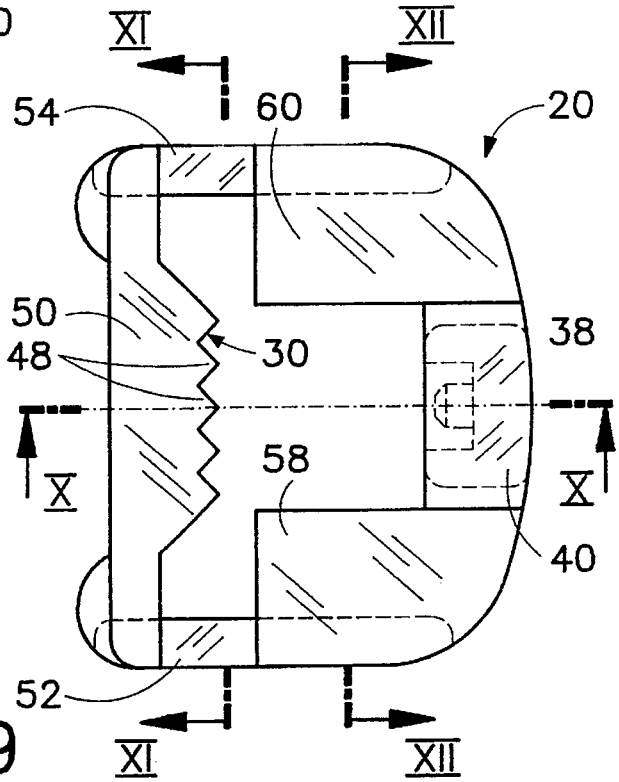
FIG. 9 is a top plan view of a second body part of the brassiere clip or strap fastener of FIGS. 1–3.
Figure 14:
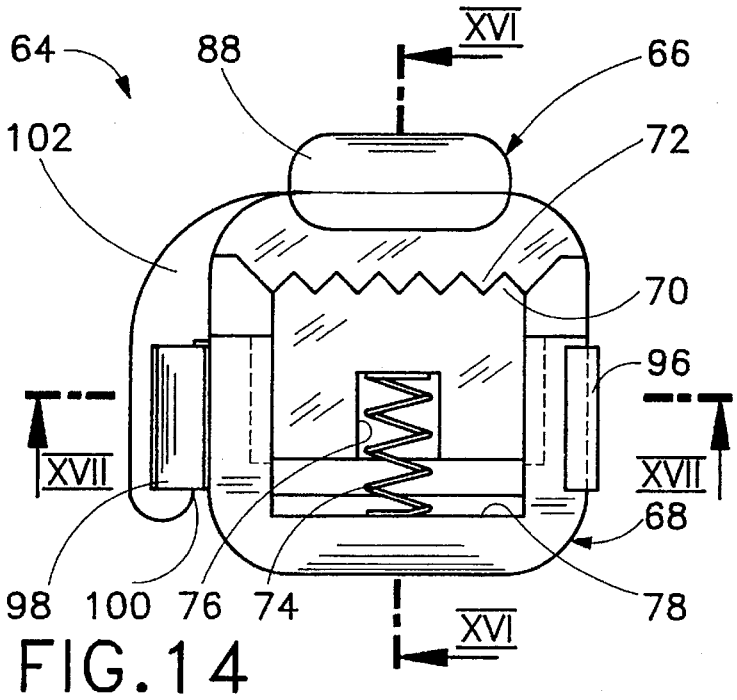
FIG. 14 is a top plan view of another brassiere clip or strap fastener in accordance with the present invention.
Figure 15:
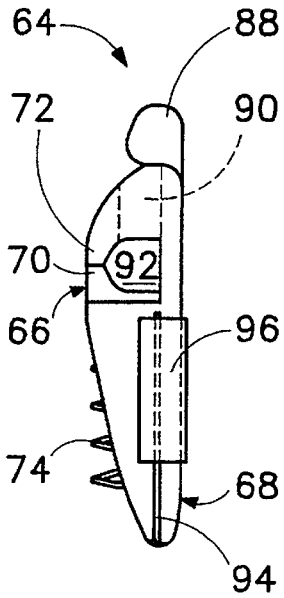
FIG. 15 is a side elevational view of the brassiere clip or strap fastener of FIG. 14, taken from the right side in FIG. 14.

As shown in FIG. 9 and 11, jaw 30 includes a row of serrations or teeth 48 disposed on a cross-piece 50 connected at opposite ends to a pair of parallel rails or bars 52 and 54 of body part 20. Cross-piece 50 is provided with a recess 56 (FIG. 11) which receives push block 46 during a compression of spring 34. Push block 40 is connected to rails 52 and 54 via a pair of flange members 58 and 60.

As shown in FIG. 2, jaw 28 is spaced from plate 22 and jaw 30 is spaced from rails 52, 54, thereby defining a space 62 for receiving material of blouse 16, such as seam overlap material.

Figure 3:
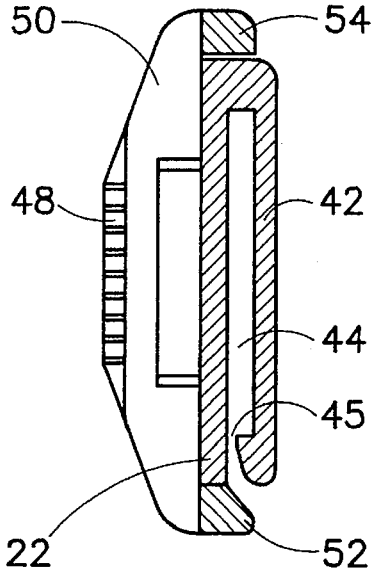
FIG. 3 is a cross-sectional view taken along line III—III in FIG. 1.

As illustrated in FIGS. 14–19, another brassiere strap coupling device 64 comprises first and second body parts 66 and 68 slidably coupled to one another. Each body part 66 and 68 is provided with a respective serrated or toothed jaw 70 and 72 which cooperates with the other to clamp or clasp a piece of fabric material along seam 32 (FIG. 3). Parts 66 and 68, and accordingly jaws 70 and 72, are biased towards one another by a helical compression spring 74 having one end disposed in a recess 76 in body part 66 and an opposite end pressed against an inwardly facing surface 78 of body part 68. Body part 66 is formed with a pair of keys or ribs 80 and 82 (FIG. 17) which are slidably seated in respective grooves 84 and 86 on body part 68.

Body part 66 has a push block 88 which can pass into a recess or tunnel 90 (FIG. 16) on body part 68 during a compressing of spring 74. Body parts 66 and 68 define a space 92 (FIG. 16) for receiving fabric material inserted between jaws 70 and 72 upon an opening or separation thereof.

Figure 17:
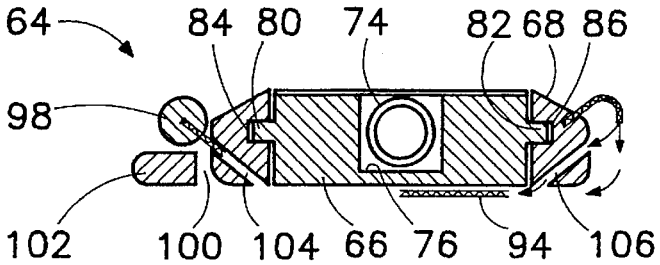
FIG. 17 is a cross-sectional view taken along line XVII—XVII in FIG. 14.
Figure 16:
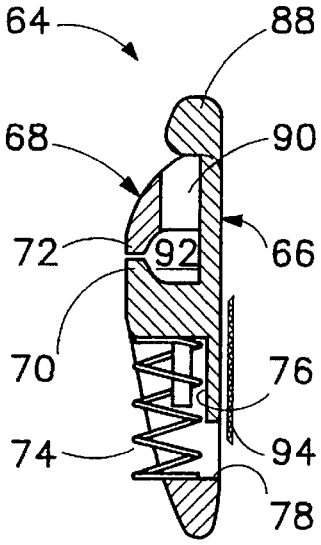
FIG. 16 is a cross-sectional view taken along line XVI—XVI in FIG. 14.
Figure 18:
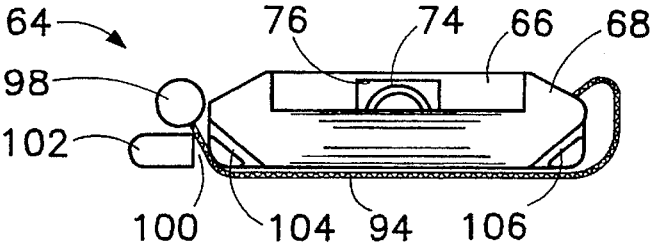
FIG. 18 is a rear elevational view of the brassiere clip or strap fastener of FIG. 14, taken from the bottom in FIG. 14.
Figure 19:
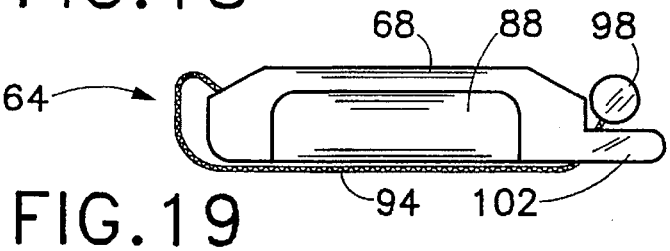
FIG. 19 is a front elevational view of the brassiere clip or strap fastener of FIG. 14, taken from the top in FIG. 14.
Figure 21:
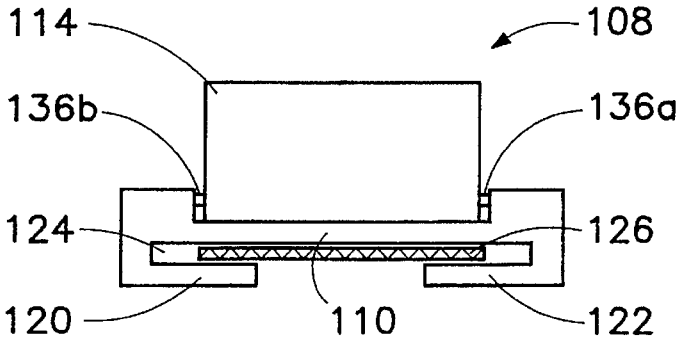
FIG. 21 is a side elevational view of the brassiere clip or strap fastener of FIG. 20, taken from the right side in FIG. 20.
Figure 22:
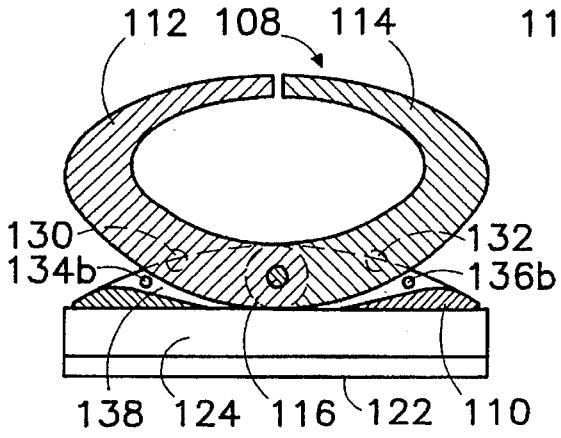
FIG. 22 is a cross-sectional view taken along line XX—XX in FIG. 20.
Figure 20:
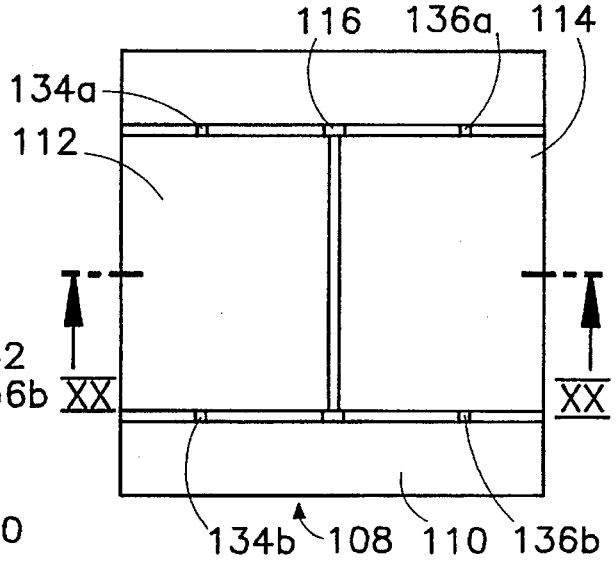
FIG. 20 is a top plan view of a further brassiere clip or strap fastener in accordance with the present invention.
Figure 23:
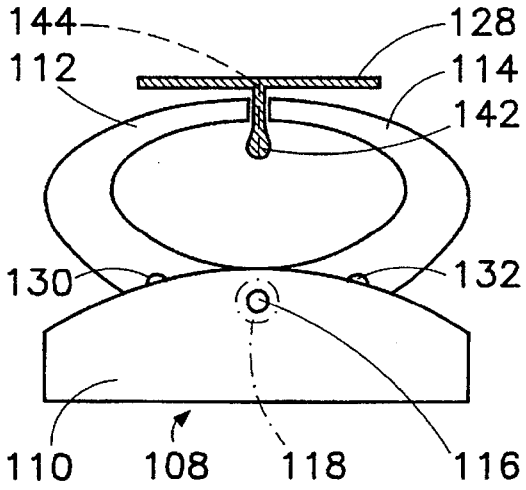
FIG. 23 is a side elevational view of the brassiere clip or strap fastener of FIG. 20, taken from the bottom in FIG. 20.
Figure 24:
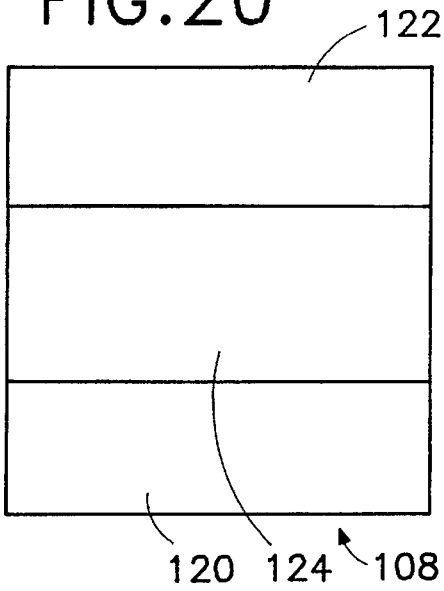
FIG. 24 is a bottom elevational view of the brassiere clip or strap fastener of FIG. 20.

For purposes of attaching the coupling device 64 to a brassiere strap 12 (FIG. 30), device 64 is provided with a resilient or stretchable band 94 attached at one end to body part 68 via a handle 96 (FIGS. 14 and 15) and attachable at an opposite end to body part 68 with the assistance of a stop 98. At that opposite end, band 94 is insertable into a slot 100 formed by an arm 102 on body part 68. Stop 98, acting together with the resiliency of band 94, prevents the band 94 from sliding through slot 100. As shown in FIGS. 17 and 18, body part 68 may be provided with slots 104 and 106 through which band 94 may be passed to accommodate larger brassiere straps.

Brassiere strap coupling device 64 operates essentially the same as device 10. Fabric material along shoulder seam 32 of blouse 16 is clamped between jaws 70 and 72 in a plane oriented substantially perpendicularly to a line defined by brassiere strap 12 upon a capturing thereof by band 94. A thumb and a forefinger are generally used to linearly shift body parts 66 and 68 in opposition to a biasing force exerted by compression spring 74. It is to be noted that band 94 may be used with device 10, while base plate 42 and slot 44 Of device 10 may be used in device 64 instead of band 94.

As depicted in FIGS. 20–24, another brassiere strap coupling device 108 comprises a body part or frame 110 to which a pair of C-shaped jaws 112 and 114 are pivotably attached for partial rotation about a pivot pin or axle 116. Jaws 112 and 114 are spring biased toward a closure configuration by a helical torsion spring schematically represented at 118 in FIG. 23.

Frame 110 is provided along a lower side with a pair of L-shaped flanges 120 and 122 which define a slot 124 for receiving a brassiere strap 126. To attach an overlying garment 128 to strap 126, jaws 112 and 114 are spread apart, in opposition to an angular restoring force exerted by spring 118, until pairs of notches 130 and 132 (FIGS. 22 and 23) in side walls (not designated) of clamping jaws 112 and 114 receive, in a snap-lock fit, respective beads 134*a*, 134*b* and 136*a*, 136*b* formed on an inwardly facing surface 138 of body part 110. At that juncture, a fabric overlap 142 along a shoulder seam 144 of garment 128 is inserted between the separated jaws 112 and 114. The jaws 112 and 114 are then closed by pressing them towards one another to break the snap-lock fit of beads 134*a*, 134*b*, 136*a*, 136*b* in notches 130 and 132.

Again, during use of device 108, fabric overlap 142 along a shoulder seam 144 of garment 128 is clamped between jaws 112 and 114 in a plane oriented substantially perpendicularly to a line defined by brassiere strap 126.

As shown in FIGS. 25–29, an additional brassiere strap coupling device 146 includes a body part 148 provided along a lower side with a slot 150 for receiving a brassiere strap 12 (FIG. 30). A fabric capture member in the form of a fork 152 is attached to body part 148 via a pivot pin 154, whereby fork 152 is rotatable about an axis 156. Fork 152 has three resilient prongs 158 with tips 160 which, in a locked configuration of device 146, are inserted into a slot 162 on body part 148. To attach a piece of fabric from an overlying garment 16 (see FIG. 30), fork 152 is turned about axis 156 to remove prong tips 160 from slot 162. Prongs 158 are then inserted through overlying fabric material, whereupon fork 152 is twisted in an opposite direction about axis 156 to reinsert prong tips 160 into slot 162.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A clothing accessory device comprising:

a first body part;

a second body part slidably coupled to said first body part;

first fastener means on said first body part for coupling said first body part to a strap of a brassiere;

second fastener means including a first jaw on said first body part and a second jaw on said second body part for releasably clamping an article of clothing overlying the brassiere during use thereof, thereby coupling said first body part and said second body part to said article of clothing; and spring means engaging said first body part and said second body part for biasing said first jaw and said second jaw towards one another.

2. The device defined in claim 1 wherein said spring means includes a compression spring disposed between said first body part and said second body part.

3. The device defined in claim 1 wherein said first jaw and said second jaw engage one another in a plane oriented substantially perpendicularly to the brassiere strap when said brassiere strap is coupled to said body part via said first fastener means.

4. The device defined in claim 1 wherein said first fastener means includes a slot provided on said body part.

5. The device defined in claim 1 wherein said first fastener means includes a band having at least one end removably attached to said body part.

6. A clothing method comprising:

providing a brassiere, a woman's garment, and a coupling device, said coupling device includes a spring loaded component;

attaching said coupling device to a strap of said brassiere;

securing said coupling device to an inwardly extending edge section disposed along a shoulder seam of said garment along an inner side thereof, the securing of said coupling device to said garment includes operating said spring loaded component to releasably catch said garment; and applying said brassiere and said garment to a person, said coupling device connecting the brassiere strap to the garment so that the brassiere Strap remains hidden under said garment at all times.

7. The method defined in claim 6 wherein said spring loaded component includes a pair of opposed jaws biased towards one another by a spring, the operating of said spring loaded component including exerting a force against a bias of said spring to separate said jaws from one another, the securing of said coupling device to said garment further including inserting a part of said garment between the open jaws and closing the jaws on said part of said garment.

8. The method defined in claim 7 wherein upon attachment of said coupling device to said brassiere strap and securing of said coupling device to said garment, said jaws engage said garment in a plane oriented substantially perpendicularly to the brassiere strap.

9. The method defined in claim 8 wherein the operating of said spring loaded component includes slidably shifting said jaws relative to one another in opposition to a spring force.

10. The method defined in claim 6 wherein said spring loaded component includes a fork with resilient prongs, the securing of said coupling device to said garment including a step of piercing said garment with said prongs.

11. The method defined in claim 10 wherein said fork is pivotably attached to said body part, the securing of said coupling device to said garment including pivoting said fork from a latched position to an opened position, whereupon said garment is pieced with said prongs, said fork being pivoted back from said opened position to said latched position after piercing of said garment with said prongs.

12. The method defined in claim 6 wherein the attaching of said coupling device to said brassiere strap includes inserting said brassiere strap into a slot on said coupling device.

13. The method defined in claim 6 wherein the attaching of said coupling device to said brassiere strap includes passing a band about said brassiere strap and fastening said band to said coupling device.

14. A clothing method comprising:

providing a brassiere, a woman's garment, and a coupling device having a pair of clamping parts slidably connected to one another;

attaching said coupling device to a strap of said brassiere;

securing said coupling device to said garment along an inner side thereof by:

moving said clamping parts relative to one another in a first linear direction, inserting a portion of said garment between said clamping parts; and moving said clamping parts relative to one another in a second, opposite, linear direction to clamp said portion of said garment between said clamping parts; and applying said brassiere and said garment to a person, said coupling device connecting the brassiere strap to the garment so that the brassiere strap remains hidden under said garment at all times.

15. The method defined in claim 14 wherein said coupling device includes a spring loaded component, the moving of said clamping parts relative to one another in said first linear direction being in opposition to a spring force exerted by said spring loaded component.

16. The method defined in claim 14 wherein upon attachment of said coupling device to said brassiere strap and securing of said coupling device to said garment, said clamping parts engage said garment in a plane oriented substantially perpendicularly to the brassiere strap.

17. The method defined in claim 14 wherein said portion of said garment is an inwardly extending edge section disposed along a shoulder seam of said garment.

* * * * *